US010007282B2

(12) United States Patent
Deguchi

(10) Patent No.: US 10,007,282 B2
(45) Date of Patent: Jun. 26, 2018

(54) VOLTAGE REGULATOR

(71) Applicant: SII Semiconductor Corporation, Chiba-shi, Chiba (JP)

(72) Inventor: Michiyasu Deguchi, Chiba (JP)

(73) Assignee: ABLIC INC., Chiba (JP)

( * ) Notice: Subject to any disclaimer, the term of this patent is extended or adjusted under 35 U.S.C. 154(b) by 0 days. days.

(21) Appl. No.: 15/664,617

(22) Filed: Jul. 31, 2017

(65) Prior Publication Data

US 2018/0039296 A1 Feb. 8, 2018

(30) Foreign Application Priority Data

Aug. 2, 2016 (JP) ..... 2016-152111

(51) Int. Cl.
*G05F 1/56* (2006.01)
*G05F 1/567* (2006.01)
*G05F 1/575* (2006.01)

(52) U.S. Cl.
CPC ..... *G05F 1/567* (2013.01); *G05F 1/575* (2013.01)

(58) Field of Classification Search
CPC . G05F 1/56; G05F 1/567; G05F 1/468; G05F 1/10; G05F 1/565
USPC ..... 323/271–276, 282–284, 311–316
See application file for complete search history.

(56) References Cited

U.S. PATENT DOCUMENTS 6,985,027 B2 * 1/2006 Yabe ..... G05F 1/565 323/316
7,928,708 B2 * 4/2011 Takada ..... G05F 1/565 323/274
8,922,188 B2 * 12/2014 Sakaguchi ..... H03H 11/1213 323/286
9,367,073 B2 * 6/2016 Tomioka ..... G05F 1/567
9,529,374 B2 * 12/2016 Enjalbert ..... G05F 1/575

FOREIGN PATENT DOCUMENTS

JP 2005-327027 A 11/2005

* cited by examiner

*Primary Examiner* — Rajnikant Patel
(74) *Attorney, Agent, or Firm* — Brinks Gilson & Lione

(57) ABSTRACT

Provided is a voltage regulator capable of stably generating a constant output voltage even in a high temperature environment. The voltage regulator includes: an output transistor; an output terminal connected to a drain of the output transistor and outputting an output voltage; an error amplifier circuit configured to supply a signal obtained by amplifying a difference between a divided voltage of the output voltage and a reference voltage to a gate of the output transistor; and an NMOS transistor connected between the output terminal and a reference potential and configured to turn on, when the voltage regulator reaches a predetermined temperature at which a leakage current flowing in the output transistor is absorbed, to lead the leakage current to the reference potential.

6 Claims, 2 Drawing Sheets

VOLTAGE REGULATOR

RELATED APPLICATIONS

This application claims priority under 35 U.S.C. § 119 to Japanese Patent Application No. 2016-152111 filed on Aug. 2, 2016, the entire content of which is hereby incorporated by reference.

BACKGROUND OF THE INVENTION

1. Field of the Invention

The present invention relates to a voltage regulator.

2. Description of the Related Art

A related-art voltage regulator generally includes a reference voltage circuit, an error amplifier circuit, an output transistor, and a voltage-dividing resistor, and generates a constant output voltage at an output terminal (see, for example, Japanese Patent Application Laid-open No. 2005-327027).

Such a voltage regulator is used in various electronic devices, and is also used in a motor vehicle.

Various semiconductor devices used in a motor vehicle need to operate in a high temperature environment, and hence a leakage current of the output transistor easily increases in the voltage regulator. As a result, the following problem arises.

In the voltage regulator, the leakage current flowing in the output transistor increases at high temperature. In particular, when a current flowing in a load connected to the output terminal is extremely small or when there is no load, the output voltage at the output terminal rises due to the leakage current, thereby exceeding the upper limit of a predetermined regulation range.

SUMMARY OF THE INVENTION

The present invention provides a voltage regulator capable of stably generating a constant output voltage even in a high temperature environment.

In one embodiment of the present invention, there is provided a voltage regulator including: an output transistor; an output terminal connected to a drain of the output transistor and outputting an output voltage; an error amplifier circuit configured to supply a signal obtained by amplifying a difference between a divided voltage of the output voltage and a reference voltage to a gate of the output transistor; and an NMOS transistor connected between the output terminal and a reference potential and configured to turn on, at a predetermined temperature at which a leakage current flowing in the output transistor is absorbed, to lead the leakage current to the reference potential.

According to a voltage regulator of the present invention, leakage current can be led to the reference potential by the NMOS transistor before the leakage current starts to increase due to temperature rise, that is, can be absorbed the leakage current by setting the predetermined temperature at which absorption of the leakage current begins to, for example, a temperature lower than a temperature at which the leakage current flowing in the output transistor starts to rapidly increase when the operation in a high temperature environment is needed.

Consequently, it is possible to prevent the voltage at the output terminal from rising even at high temperature at which the leakage current of the output transistor increases.

BRIEF DESCRIPTION OF THE DRAWINGS

Embodiments of the invention will now be described, by way of example, with reference to the accompanying drawings, in which.

DETAILED DESCRIPTION OF THE PREFERRED EMBODIMENTS

The invention will be now described herein with reference to illustrative embodiments.

Figure 1:
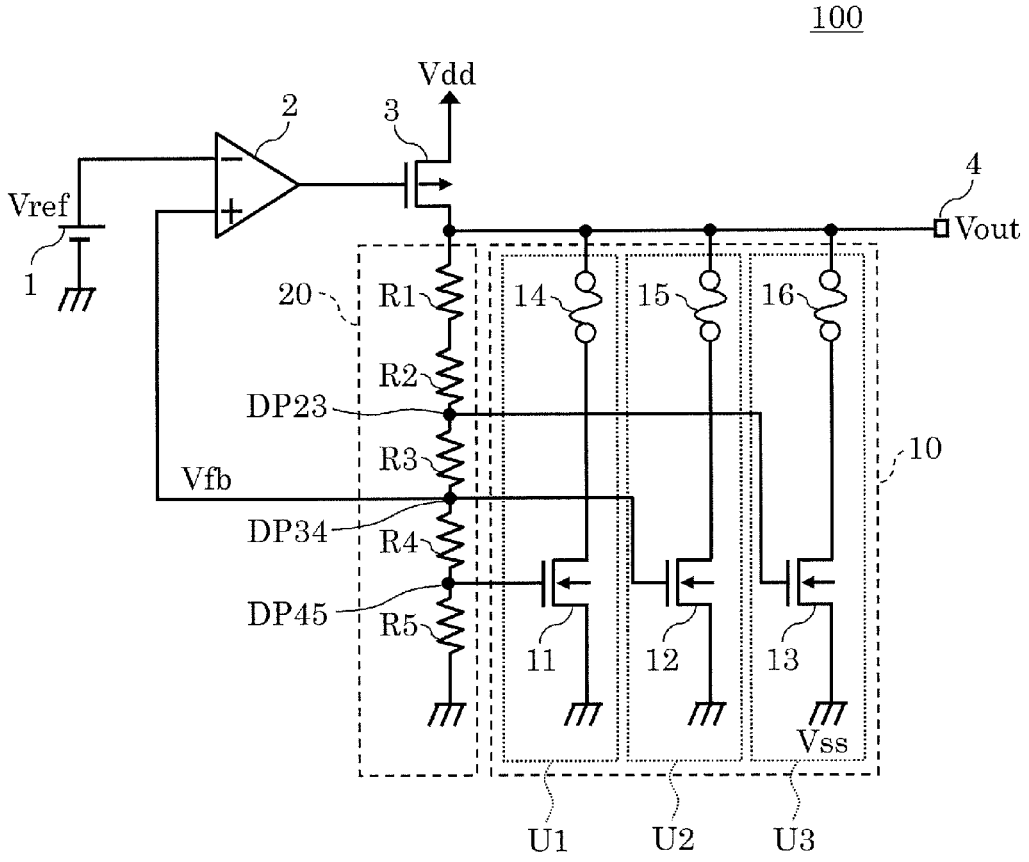
FIG. 1 is a circuit diagram for illustrating a voltage regulator according to an embodiment of the present invention.

FIG. 1 is a circuit diagram for illustrating a voltage regulator 100 according to an embodiment.

The voltage regulator 100 includes a reference voltage source 1, an error amplifier circuit 2, an output transistor 3, an output terminal 4, a leakage current absorbing circuit 10, and a resistor circuit 20.

The resistor circuit 20 includes a plurality of resistors R1 to R5 connected in series between the output terminal 4 and a reference potential Vss.

The error amplifier circuit 2 supplies, to a gate of the output transistor 3, a signal obtained by amplifying a difference between a reference voltage Vref of the reference voltage source 1 and a feedback voltage Vfb which is a voltage obtained by dividing a voltage at the output terminal 4 with the resistors R1 to R3 and the resistors R4 and R5 in the resistor circuit 20.

With this configuration, an output voltage Vout generated at the output terminal 4 connected to a drain of the output transistor 3 is stabilized at a voltage at which the reference voltage Vref and the feedback voltage Vfb are balanced with each other.

The leakage current absorbing circuit 10 includes a plurality of circuit units U1 to U3. The circuit unit U1 includes a fuse 14 having one end connected to the output terminal 4, and an NMOS transistor 11 connected between the other end of the fuse 14 and the reference potential Vss. The circuit unit U2 includes a fuse 15 having one end connected to the output terminal 4, and an NMOS transistor 12 connected between the other end of the fuse 15 and the reference potential Vss. The circuit unit U3 includes a fuse 16 having one end connected to the output terminal 4, and an NMOS transistor 13 connected between the other end of the fuse 16 and the reference potential Vss.

Gates of the NMOS transistors 11 to 13 of the circuit units U1 to U3 are connected to voltage dividing points DP45, DP34, and DP23 of the resistor circuit 20, respectively, to receive divided voltages generated at the respective voltage dividing points.

The leakage current of the output transistor 3 increases at high temperature, thereby exceeding a current flowing to the resistor circuit 20 in a normal temperature environment. At this time, according to this embodiment, the leakage current absorbing circuit 10 absorbs a current that is nearly equal to or greater than the leakage current flowing in the output transistor 3, to thereby reduce the leakage current from the output transistor 3 flowing to the resistor circuit 20, permitting the suppression of a rise of the output voltage Vout.

Next, the leakage current absorbing circuit 10 and the resistor circuit 20, which are characteristic configurations of this embodiment, are described in detail.

Figure 2:
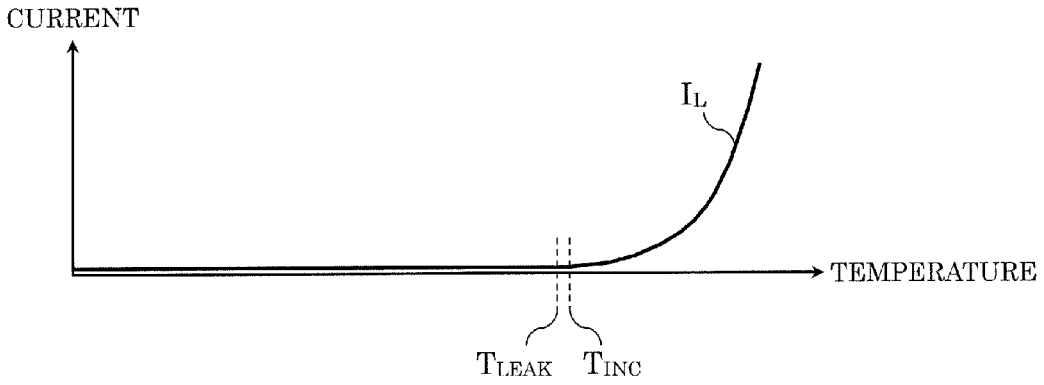
FIG. 2 is a graph for showing temperature dependence of a leakage current of an output transistor.

In FIG. 2, temperature dependence of the leakage current of the output transistor 3 is shown.

As can be seen from FIG. 2, a leakage current IL of the output transistor 3 has the following tendency. The leakage current IL hardly flows up to a temperature $T_{INC}$. However, the leakage current IL starts to increase after exceeding the temperature $T_{INC}$, and steeply increases thereafter.

Hence, as shown in FIG. 2, a temperature at which absorption of the leakage current starts, that is, a temperature $T_{LEAK}$ at which the leakage current absorbing circuit 10 starts to operate is preferably set to a temperature lower than the temperature $T_{INC}$ at which the leakage current IL starts to increase, permitting prevention of the output voltage Vout from rising and exceeding the upper limit of the predetermined regulation range even at high temperature.

Specifically, among the circuit units U1 to U3 of the leakage current absorbing circuit 10 shown in FIG. 1, any one of those circuit units operating at the temperature $T_{LEAK}$ is set operable, and two circuit units other than the operable one are set inoperable by cutting the fuses thereof, to thereby enable suppression of the rise of the output voltage Vout at high temperature.

More specifically, when the temperature $T_{LEAK}$ is set lower than the temperature $T_{INC}$ at which the leakage current IL starts to increase as described above, and when a threshold voltage of each of the NMOS transistors 11 to 13 measured at a temperature T0 (for example, normal temperature) is denoted by Vth0 and a temperature coefficient of the threshold voltage of each of the NMOS transistors 11 to 13 is denoted by Tc, any one of the plurality of voltage dividing points DP23, DP34, and DP45, at which the generated voltage has a closest value to a voltage Vg, is selected. The voltage Vg is obtained by the following expression (1).

$$Vg = Vth0 - (T_{LEAK} - T0) * |Tc| \quad (1)$$

Then, when the selected voltage dividing point is, for example, DP45, the fuse 14 connected to the NMOS transistor 11 having the gate connected to the voltage dividing point DP45 is not cut, and the other fuses 15 and 16 are cut.

With this configuration, when the temperature reaches the temperature $T_{LEAK}$, the NMOS transistor 11 having the gate connected to the voltage dividing point DP45, at which the voltage is substantially the voltage Vg, turns on, and thus the leakage current of the output transistor 3 flows to the reference potential Vss via the NMOS transistor 11.

As a result, even when the temperature rises and the leakage current of the output transistor 3 increases, the leakage current absorbing circuit 10 starts to operate to absorb the leakage current before the leakage current of the output transistor 3 starts to increase, to thereby suppress the rise of the output voltage Vout.

Now, description is made of how to set the temperature T0, the threshold voltage Vth0 of each of the NMOS transistors 11 to 13, and the temperature coefficient Tc of the threshold voltage of each of the NMOS transistors 11 to 13.

A threshold voltage of a MOS transistor generally has a temperature coefficient of about −2 mV/° C., and hence the temperature coefficient Tc is set to −2 mV/° C.

The threshold voltage Vth0 and the temperature T0 are set in the following manner.

Figure 3:
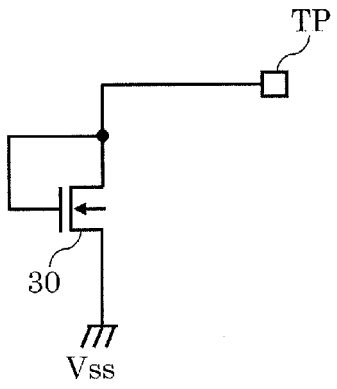
FIG. 3 is a diagram for illustrating a test circuit for measuring a threshold voltage of an NMOS transistor.

First, a test NMOS transistor 30, which is illustrated in FIG. 3 and has the same configuration as those of the NMOS transistors 11 to 13, is formed on the same chip as the NMOS transistors 11 to 13. The test NMOS transistor 30 has a gate and a drain that are connected to a test pad TP, and a source connected to the reference potential Vss.

A threshold voltage Vtht0 of the test NMOS transistor 30 can be measured by applying, for the test NMOS transistor 30 having the above-mentioned configuration, a voltage to the test pad TP from outside at the temperature T0 and measuring a voltage at which a current starts to flow.

As described above, the test NMOS transistor 30 is formed on the same chip as the NMOS transistors 11 to 13 and has the same configuration as those of the NMOS transistors 11 to 13, and hence the threshold voltage Vtht0 of the test NMOS transistor 30 and the threshold voltage Vth0 of the NMOS transistors 11 to 13 at the temperature T0 may be regarded to be almost the same. Accordingly, the threshold voltage Vth0 of the NMOS transistors 11 to 13 at the temperature T0 is set to the threshold voltage Vtht0 of the test NMOS transistor 30 measured as described above.

The threshold voltage Vth0 has been set as described above, and hence the temperature T0 is set to the same temperature T0 at which the threshold voltage Vtht0 has been measured.

The voltage value of Vg can be determined by substituting the temperature T0, the threshold voltage Vth0, and the temperature coefficient Tc of the threshold voltage, which are set as described above, and the temperature $T_{LEAK}$ into the above expression (1).

The desired effect can be obtained when the temperature $T_{LEAK}$ at which the leakage current is to be absorbed is set to be lower than the temperature $T_{INC}$ at which the leakage current IL starts to increase as described above. However, it is preferred that the temperature $T_{LEAK}$ be not set to be too low but be set to a temperature just below the temperature $T_{INC}$ at which the leakage current IL starts to increase. With this configuration, the leakage current absorbing circuit 10 can be made inoperable at a unnecessarily low temperature, and thus unnecessary increase of the current consumption can be prevented due to an operation of the leakage current absorbing circuit 10 at low temperature.

The embodiment of the present invention has been described above, but the present invention is not limited to the above-mentioned embodiment, and it is to be understood that various modifications can be made thereto within the range not departing from the gist of the present invention.

For example, in the above-mentioned embodiment, there is exemplified a configuration in which three circuit units including the fuses and the NMOS transistors are formed, and the gates of the NMOS transistors of the circuit units are connected to three voltage dividing points among the plurality of voltage dividing points of the resistor circuit 20, respectively. However, the present invention is not limited thereto. Specifically, the voltage regulator of the present invention may have a configuration in which more circuit units, for example, six circuit units, are formed, the number of series resistors in the resistor circuit 20 are increased so that there are at least six voltage dividing points, and gates of NMOS transistors of the circuit units are connected to six voltage dividing points among the at least six voltage dividing points, respectively. In this case, the number of resistors, NMOS transistors, and fuses increases through increase of the number of circuit units and voltage dividing points, with the result that a circuit size becomes larger. However, a voltage dividing point having a voltage value closer to or equal to the calculated voltage value Vg may be obtained, and thus the leakage current absorbing circuit 10 can be made operable reliably at the desired temperature $T_{LEAK}$.

What is claimed is:

1. A voltage regulator, comprising:

an output transistor;

an output terminal connected to a drain of the output transistor and outputting an output voltage;

an error amplifier circuit configured to supply a signal obtained by amplifying a difference between a divided voltage of the output voltage and a reference voltage to a gate of the output transistor; and a plurality of fuses each having one end connected to the output terminal and a plurality of NMOS transistors connected between the output terminal and a reference potential and configured to turn on, when the voltage regulator reaches a predetermined temperature at which a leakage current flowing in the output transistor is absorbed, to lead the leakage current to the reference potential.

2. A voltage regulator, comprising:

an output transistor;

an output terminal connected to a drain of the output transistor and outputting an output voltage;

an error amplifier circuit configured to supply a signal obtained by amplifying a difference between a divided voltage of the output voltage and a reference voltage to a gate of the output transistor; and a leakage current absorbing circuit including a plurality of circuit units and configured to absorb a leakage current flowing in the output transistor by one of the plurality of circuit units, the plurality of circuit units being connected to the output terminal and configured to operate at respective different temperatures, wherein, among the plurality of circuit units, a circuit unit having an operating temperature closest to a predetermined temperature at which the leakage current is absorbed is set operable, and circuit units other than the circuit unit are set operable is set inoperable.

3. A voltage regulator, comprising:

an output transistor;

an output terminal connected to a drain of the output transistor and outputting an output voltage;

a leakage current absorbing circuit including a plurality of fuses each having one end connected to the output terminal and a plurality of NMOS transistors each connected between the other end of each of the plurality of fuses and a reference potential;

a resistor circuit including a plurality of resistors connected in series between the output terminal and the reference potential; and an error amplifier circuit configured to supply a signal obtained by amplifying a difference between a divided voltage of the output voltage generated at any one of a plurality of voltage dividing points in the resistor circuit and a reference voltage to a gate of the output transistor, wherein gates of the plurality of NMOS transistors are connected to different voltage dividing points among the plurality of voltage dividing points, respectively, thereby receiving different voltages.

4. The voltage regulator according to claim 3, wherein the plurality of fuses are cut except for one of the plurality of fuses.

5. The voltage regulator according to claim 4, wherein the gate of one of the plurality of NMOS transistors connected to any one of the plurality of fuses is connected to any one of the plurality of voltage dividing points at which a voltage closest to a voltage Vg is generated, the voltage Vg being obtained by the following expression:

$$Vg = Vth0 - (TLEAK - T0) * |Tc|,$$

where Vth0 is a threshold voltage of each of the plurality of NMOS transistors measured at a temperature T0, Tc is a temperature coefficient of the threshold voltage of each of the plurality of NMOS transistors, and TLEAK is a temperature at which the leakage current absorbing circuit is caused to operate.

6. The voltage regulator according to claim 5, wherein the threshold voltage Vth0 is a threshold voltage of a test NMOS transistor having the same configuration as a configuration of each of the plurality of NMOS transistors and including a gate and a drain that are connected to a test pad and a source connected to the reference potential, the threshold voltage of the test NMOS transistor being measured by forming the test NMOS transistor on the same chip as the plurality of NMOS transistors and applying a voltage to the test pad at the temperature T0.

* * * * *